United States Patent [19]

Paik

[11] 4,251,973

[45] Feb. 24, 1981

[54] I-BEAM CONSTRUCTION AND PROCESS THEREFOR

[76] Inventor: Young J. Paik, 7011 Calle Quieta, Rancho Palos Verdes, Calif. 90274

[21] Appl. No.: 132,386

[22] Filed: Apr. 7, 1980

Related U.S. Application Data

[63] Continuation-in-part of Ser. No. 98, Jan. 2, 1979.

[51] Int. Cl.[3] ..... E04C 3/30

[52] U.S. Cl. ..... 52/729; 29/155 R; 52/730

[58] Field of Search ..... 52/729, 730, 731; 29/155 R, 155 C

[56] References Cited

U.S. PATENT DOCUMENTS

| | | | |
|---|---|---|---|
| 101,015 | 3/1870 | Holms | 52/729 |
| 1,837,088 | 12/1931 | Watson | 52/729 |
| 2,056,563 | 10/1936 | Budd | 52/729 |
| 2,065,493 | 12/1936 | Grenlich | 52/729 |
| 2,108,795 | 2/1938 | Budd | 52/729 |
| 2,605,867 | 8/1952 | Goodwin | 52/729 |

FOREIGN PATENT DOCUMENTS

| | | | |
|---|---|---|---|
| 46414 | 6/1889 | Austria | 52/729 |
| 142000 | 6/1935 | Austria | 52/729 |
| 180240 | 11/1954 | Austria | 29/155 |
| 538635 | 11/1931 | Fed. Rep. of Germany | 29/155 |
| 704320 | 5/1931 | France | 52/729 |
| 749606 | 7/1933 | France | 52/729 |
| 542084 | 4/1956 | Italy | 52/729 |
| 381480 | 10/1932 | United Kingdom | 52/729 |

*Primary Examiner*—Price C. Faw, Jr.
*Assistant Examiner*—Henry E. Raduazo
*Attorney, Agent, or Firm*—George J. Netter

[57] ABSTRACT

An I-beam has a pair of flanges separated by a web including corrugations extending transversely of the two flanges. Immediately adjacent each side of the web interconnecting the two flanges, there is provided a flat bandlike space free of corrugations. In manufacture, a flat, sheetlike web is welded to the flanges, after which the corrugations are formed in the web.

7 Claims, 6 Drawing Figures

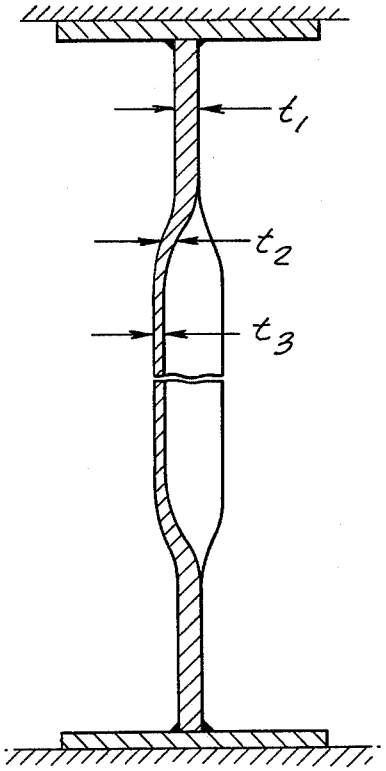
FIG. 5.
FIG. 6.
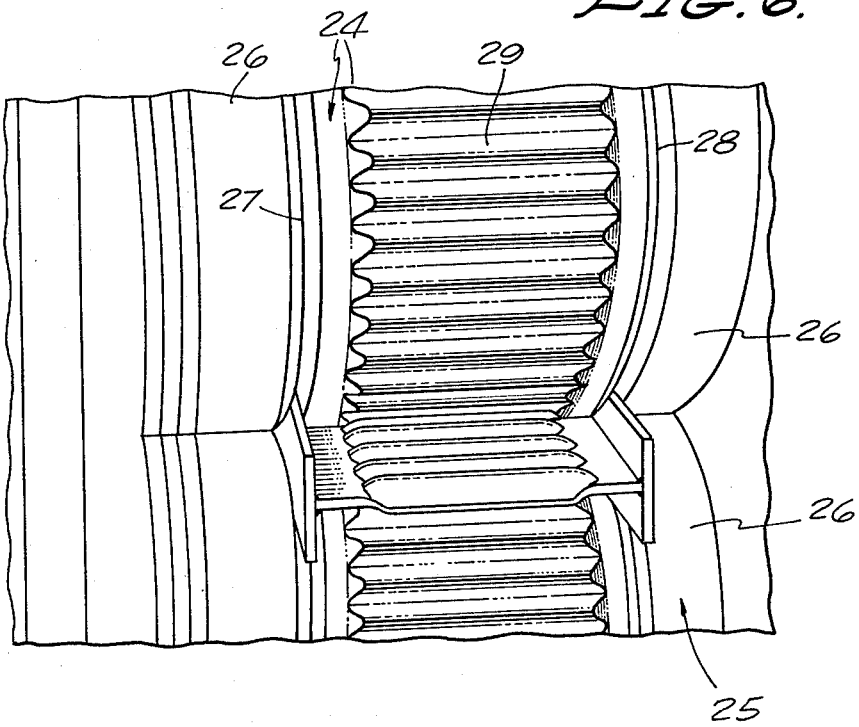

I-BEAM CONSTRUCTION AND PROCESS THEREFOR

This application is a continuation-in-part of my copending application Ser. No. 98, filed Jan. 2, 1979.

The present invention relates generally to an I-beam construction and process therefor, and, more particularly, to such a construction and process providing an I-beam with improved strength-to-weight characteristics.

BACKGROUND OF THE INVENTION

A so-called I-beam, named because of its resemblance in section to the capital letter I, is a well-known type of load-bearing member used in many applications (e.g., construction of buildings). In the usual case, and considering that the type of material used has been previously decided upon, in order to obtain a stronger I-beam or one having a greater load bearing capacity, the various parts of the I-beam have been merely increased in size which, unfortunately, also increases the weight of the beam. Alternatively, there has been the known option of using a material having a higher modulus of elasticity. However, in the usual case a material that is inherently stronger will also be more costly and may possess other physical characteristics that are not desirable. As a result of all this, in the past when it was desired to increase the load-bearing properties of an I-beam this necessitated either an increase in beam weight, the cost, or both.

A standard process for making I-beams has been to heat a billet of rectangular cross-section to an elevated temperature and engage it with forming rolls which shape the billet to the desired configuration. In this way, the I-beam flanges and web are formed at the same time. Although hot-rolled I-beams are excellent for many uses (e.g., railroad tracks) especially where very high bearing stresses are contemplated, they are relatively expensive and complex to manufacture.

Another process for manufacturing an I-beam is to assemble individual flanges and web together by edge welding the web to the flanges. Such a construction is less expensive than the hot-roll method. Welded I-beams are widely accepted and have found extensive use in the building construction industry. For example, welded beams are almost exclusively used in the construction of so-called mobile homes.

However, conventional welded I-beams have not been found to be completely satisfactory in that under certain high-load conditions the typical rectangular shaped webs have exhibited the tendency to buckle or deform permanently about a longitudinal axis (i.e., failing in bearing stress).

Still further, it is advisable under some circumstances to be able to pre-camber an I-beam (i.e., provide with unstressed curvature about a transverse axis) and this is a difficult undertaking with the usual rectangular shaped platelike web.

SUMMARY OF THE INVENTION

In the practice of the present invention there is provided an I-beam having a pair of platelike rectangular flanges separated by a web including corrugations extending transversely of the two flanges. More particularly, the normally flat material or strip from which a web for the I-beam is to be made, is rolled or otherwise formed so as to include a plurality of corrugations, with the axis about which the corrugations are formed extending transversely of the two long sides of the web. Immediately adjacent each longitudinal edge of the web, and therefore adjacent the two flanges, there is provided a longitudinally extending band that is free of corrugations so that in the final construction the corrugations are arranged to extend along the central longitudinal axis of the web and with their maximum transverse extension being substantially spaced inwardly from the web longitudinal edges. Assembly and affixing of the web to the flanges is accomplished by welding of the web edges to the flanges.

Construction of this I-beam is preferably accomplished by first welding a flat, sheetlike web to a pair of flanges. Then, the so-assembled I-beam is passed longitudinally through a set of forming rollers which provides the centralized web corrugations spaced inwardly from each flange.

DESCRIPTION OF THE DRAWING

FIG. 5 is an elevational view similar to FIGS. 2 and 3 showing detailed web thickness variations.

FIG. 6 is an end elevational view of apparatus for producing a welded I-beam having a modified web in accordance with the invention.

DESCRIPTION OF A PREFERRED EMBODIMENT

Figure 1:
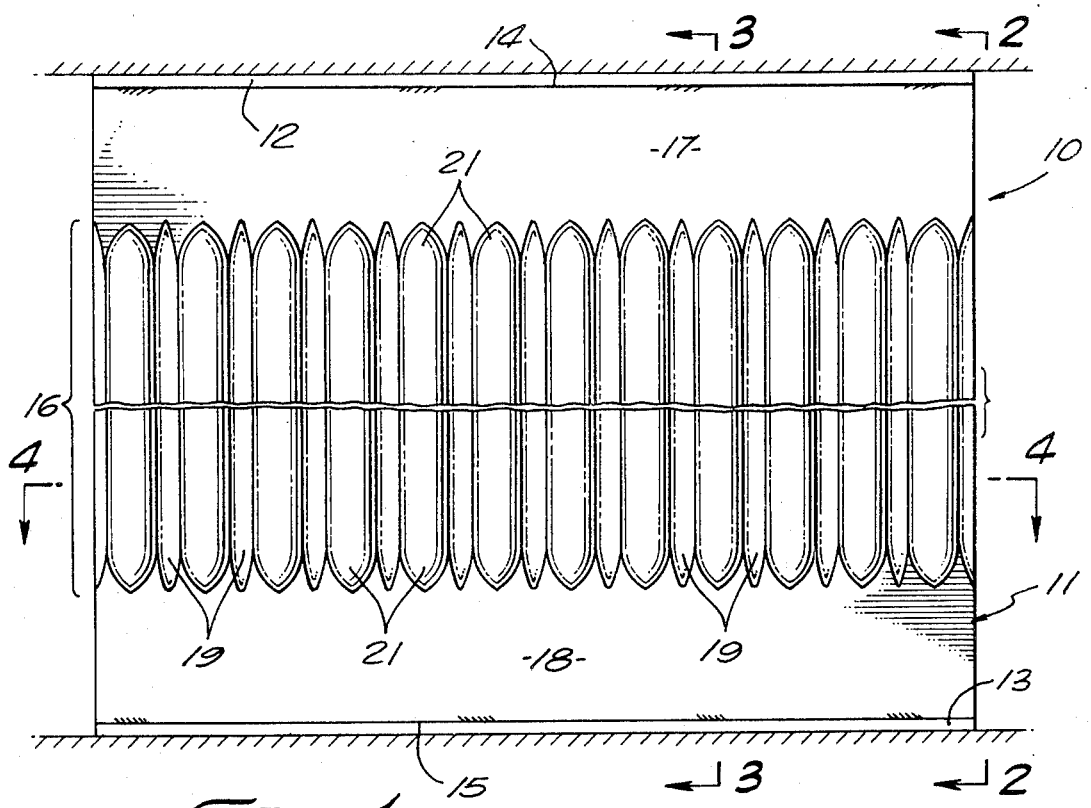
FIG. 1 is a side elevational view of the I-beam of this invention.

Turning now to the drawings and particularly to FIG. 1, the I-beam of the invention is shown illustrated generally as at 10 and is seen to include in its major parts a substantially rectangular web 11 having each of its longitudinally extending parallel side edges affixed, respectively, to flanges 12 and 13. The flanges are of conventional construction and consist of elongated rectangular or substantially rectangular metal plates which are joined by welding along their central longitudinal axis to the edges of the web to be described.

Although the invention described herein may be found advantageously used for the construction of I-beams of great variety of sizes and thicknesses of web and flanges, it is believed to be particularly advantageous for use with an I-beam having a web of undeformed thickness in the range of 0.075 to 0.50 inches (0.191–1.270 cm.). The primary reason for this is that when the beam web is modified in the manner described, it becomes increasingly more difficult and complex to achieve as the web becomes thicker.

The web 11 is an elongated, rectangular plate having two parallel longitudinal side edges 14 and 15 which in the final beam construction are welded to the respective flanges 12 and 13. The central portion of the web extending along the longitudinal axis is formed to provide a band 16 having parts that extend outwardly of the undeformed surface of the web plate. Beyond each lateral extremity of the band 16 to the web side edge 14 or 15, as the case may be, the web consists of flat, smooth surfaced metal strips or ribbons 17 and 18 extending the full length of the web.

Figure 4:
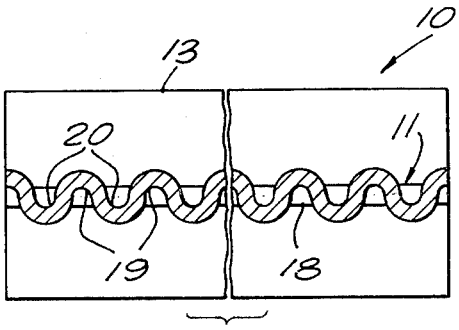
FIG. 4 is a top plan, partially sectional view of the I-beam taken along the line 3—3 of FIG. 1.

More particularly, the web central band 16 is formed into a plurality of corrugations where the metal is first bent or deformed at ninety degrees from the flat plane in one direction and then immediately adjacent portion is bent at one hundred eighty degrees therefrom. In one form of manufacture, the web corrugations may be either rolled or stamped into the flat metal sheet with the outer surfaces of each corrugation substantially equidistant from the strips or ribbons 17 and 18 considered as a central axis plane (FIG. 4). Also, such forming is preferably accomplished for strength purposes so that the corrugations are radiused as at 19 and 20 with no sharp edges which could break or otherwise fail. Moreover, it is preferable that the corrugations be interconnected with the flat regions 17 and 18 via a tapered part 21 that joins the flat regions at a relatively shallow angle (i.e., not more than about forty-five degrees). This latter feature is important in that large angle interconnections (e.g., ninety degrees) would tend to become high stress points in use that might fail.

Although the form of corrugations described and shown in the drawings is believed to be most advantageous, it is contemplated that other shaping of a flat web plate may be found useful. For example, a plurality of corrugations may be formed into the web longitudinally separated by flat uncorrugated portions.

The web edges 14 and 15 are secured to the central longitudinal axis of a major surface area of each flange by weldments 22 and 23. The band or set of corrugations 16 increase bearing strength of the I-beam over that of an I-beam of the same materials and dimensions but having a completely flat web.

In addition, since the ultimate use of the described I-beam would frequently entail support of the beam and the load carried thereby at spaced points, some deflection is experienced. Accordingly, having the uncorrugated bands 17 maintains a high degree of resistance to bending, while at the same time obtaining the enhancement of bearing strength through the band of corrugations 16. By way of explanation, if the corrugations extended across the complete width of the web the resulting I-beam would be weak in resisting deflection or bending, since the web would act very much like an accordion with vertical forces applied to the flanges tending to separate the corrugations adjacent the bottom flange and move them closer together adjacent the upper flange.

Moreover, the bands 17 and 18 enable more room for accommodating welding equipment than would be the case if the corrugations went all the way to the flanges. Also, it is manifest that a straight-line edge is more easily and more certainly, welded than would a corrugated edge, the latter having a greater probability of including unwelded or poorly welded parts with the consequent high risk of failure.

Still further, a straight-line weld as along the web edges 14 and 15 is subjected to substantially uniform shear stresses during use of the I-beam, whereas if the corrugations extended completely across the web the lines of weld to the flanges would experience a wide range of shear during use.

The width, D, of the uncorrugated strips or ribbons 17 and 18 must be substantial in order to achieve the aims and purposes of this invention. It can be shown that this width D must be twice the web metal thickness, $t_1$, as a minimum, otherwise the resulting I-beam suffers an unsupportable loss in bending strength due to the accordion effect already referred to. Moreover, where the overall thickness of the corrugations, T, is greater than twice the web metal thickness, $t_1$, it is preferable that the band width D be at least equal to T.

For certain kinds of uses it is desirable to have an I-beam pre-cambered. That is, the finished beam in this case is curved about a transverse axis while in the unstressed condition so that it will assume a straight line on loading. Pre-cambering of conventional welded I-beams is difficult, requiring construction using a specially shaped web having intially curved edges. With the present invention, only the flanges have to be specially curved since the web corrugations provide sufficient flexibility in the web plane to enable ready securement to the curved flanges as long as the amount of pre-camber is not too great.

Figure 2:
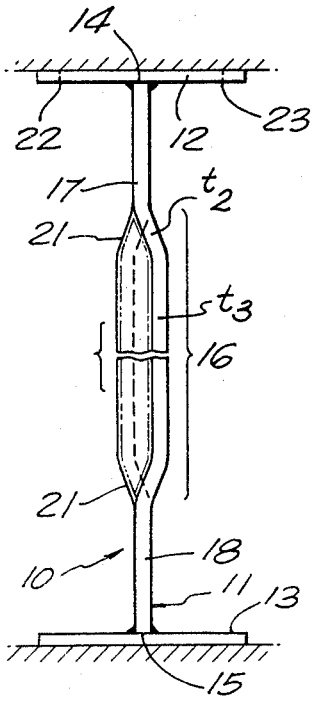
FIG. 2 is an end elevational view of the I-beam of FIG. 1.

As a still further aspect of the present invention, reference is made specifically to FIG. 2. Thus, as shown there by an alternative version, it is contemplated that the upper flange 12 of the I-beam may be narrower in width than the lower flange 13. Although in the usual case both flanges are of the same dimensions, it may be desirable for certain uses to have the flanges differ in width.

Figure 3:
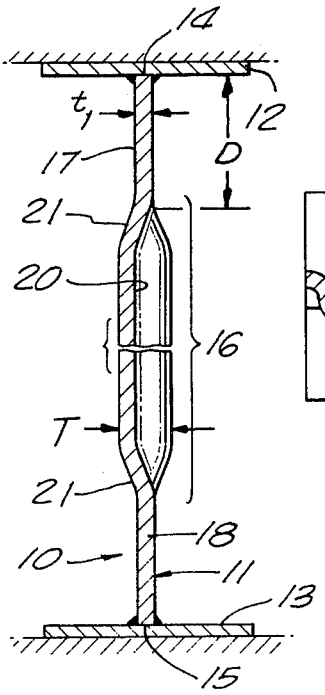
FIG. 3 is an end elevational view similar to FIG. 2.

Although the web wall is depicted in FIGS. 2 and 3 as being of uniform thickness throughout, this is not achieved practice. Thus, as is more accurately shown in FIG. 5, the flat strips or ribbons 17 and 18 have a thickness d which is the same as that of the unformed metal in its unstressed original condition. At the beginning of the corrugations, the web thickness starts to decrease as at d2 until a minimum thickness d3 is reached in the central part of the corrugations. This variation in thickness is the result of cold working of the metal to produce the corrugations. Despite this decrease in wall thickness, the overall load-bearing strength of the described I-beam is considerably enhanced over that of a conventional I-beam with a flat-sheet web of similar dimensions.

For the ensuing description of a preferred process of manufacture, reference is particularly made to FIG. 6. As shown there, a pair of rollers 24 and 25 are rotatably mounted with outer portions 26 which contactingly engage one another. First and second circumferentially extending grooves 27 and 28 are of such depth and spacing as to permit receipt of the respective flanges of an I-beam therewithin. Between the grooves 27 and 28 on each roller there is provided a set of teeth 29 of such dimensions and geometry as to form the desired corrugations in a I-beam web passing therethrough. The high points of the teeth on roller 24 are aligned with the low parts of the teeth of roller 25 in order to effect proper corrugation formation.

In summary of the process, first an I-beam is constructed of a flat-plate web welded to a pair of flanges. Then, the flange edge margins are located within the grooves 27 and 28 and the I-beam assembly is passed between the rollers where the web is formed into corrugations leaving flat, unformed ribbons or strips immediately adjacent the flanges. By this process, the spacing between flanges is maintained constant and the problems of undesired warping or deformation are obviated.

I claim:

1. In an I-beam having a web secured between a pair of plate flanges, the improvement comprising:

the web including a relatively flat plate with a plurality of first portions of the plate being formed to extend outwardly of one side of the flat plane of said plate, and a plurality of second portions of the plate being formed to extend outwardly of the other side of the flat plane of said plate, and bandlike portions immediately adjacent each flange being free of said first and second formed portions, said bandlike portions having a minimum width at least equal to twice the thickness of said portions; said web having its plate edges immediately adjacent the bandlike portions welded to the respective flanges.

2. An I-beam as in claim 1, in which the first and second portions extending outwardly of the web flat plane are elongated and longitudinally extend transversely of said flanges.

3. An I-beam as in claim 2, in which the thickness of the web forming the corrugations is less than the web thickness in said first and second regions free of corrugations.

4. In an I-beam having the side edges of an elongated rectangular web welded respectively to a major surface of first and second plate flanges, the improvement comprising:

the web includes a plurality of corrugations arranged in a band extending along the web longitudinal axis, and first and second regions extending from the band of corrugations to the respective web lateral side edges that are free of corrugations, the extent of each said region being at least equal to twice the web thickness.

5. An I-beam as in claim 4, in which each said corrugation includes an elongated deformation of the web material extending outwardly of a plane formed by said first and second regions.

6. An I-beam as in claim 5, in which the longitudinal axis of each elongated deformation is arranged transversely of the I-beam.

7. An I-beam as in claim 5, in which the extent of each region is at least equal to the total width of the corrugations measured at ninety degrees to the plane of said first and second regions.

* * * * *